United States Patent [19]

Koeneman et al.

[11] Patent Number: 4,753,081

[45] Date of Patent: Jun. 28, 1988

[54] AIR SPARGE SYSTEM FOR ICEMAKER AND ICE DISPENSER COMBINATION AND METHOD

[75] Inventors: Robert M. Koeneman, Oak Brook; Benjamin D. Miller, Chicago; Thaddeus M. Jablonski, Palatine, all of Ill.

[73] Assignee: Remcor Products Company, Franklin Park, Ill.

[21] Appl. No.: 60,044

[22] Filed: Jun. 8, 1987

[51] Int. Cl.[4] ..... F25C 1/18

[52] U.S. Cl. ..... 62/69; 62/309; 62/356

[58] Field of Search ..... 62/69, 70, 309, 356

[56] References Cited

U.S. PATENT DOCUMENTS

| | | | |
|---|---|---|---|
| 1,180,533 | 4/1916 | Pownall | 62/70 |
| 1,925,616 | 9/1933 | Velut | 62/356 X |
| 3,274,794 | 9/1966 | Wilbushewich | 62/356 X |
| 4,300,359 | 11/1981 | Koeneman et al. | 62/379 |
| 4,429,543 | 2/1984 | Fischer | 62/352 X |
| 4,641,500 | 2/1987 | Hosokawa et al. | 62/70 |

*Primary Examiner*—William E. Tapolcai

*Attorney, Agent, or Firm*—Juettner Pyle Lloyd & Verbeck

[57] ABSTRACT

An icemaker and ice dispenser combination is characterized by an air sparge system for percolating air through water in the icemaker as the water is being frozen to ice in order to produce clear ice. The air is obtained from an ice storage hopper of the ice dispenser, and after percolation through the water in the icemaker, the air is returned to the hopper for recirculation between the hopper and icemaker. By virtue of the arrangement, the air is free of outside contaminants and may be used over and over again to maintain clear ice, and since the air is chilled by ice in the hopper, increases are obtained in the cooling cycle efficiency of the icemaker. The icemaker includes an improved air diffuser that uniformly percolates air through the water.

15 Claims, 1 Drawing Sheet

AIR SPARGE SYSTEM FOR ICEMAKER AND ICE DISPENSER COMBINATION AND METHOD

BACKGROUND OF THE INVENTION

The present invention relates generally to ice making and ice dispensing apparatus, and in particular to an improved air sparge system for ice making and ice dispensing apparatus, in which air percolated through water being frozen to ice in an icemaker is obtained from an ice storage hopper of an ice dispenser and recirculated between the icemaker and ice dispenser.

In the food and beverage service industries, it is desirable to provide means for expeditiously dispensing a quantity of ice, for example into a glass, to facilitate service of ice water and cold beverages to customers. Conventionally, the means comprises an ice dispenser, which for commercial application usually includes a hopper for storing a quantity of discrete particles of ice, an icemaker for manufacturing ice for the hopper, a thermostat in the hopper for sensing the level of ice and controlling operation of the icemaker, and an agitator for the mass of ice to prevent congealing or agglomeration, in order to maintain the ice particles in discrete, free flowing form. An opening at the bottom of the hopper enables ice to be removed from the hopper, for example by a dispensing unit which automatically dispenses ice.

If water were simply frozen to ice in the icemaker, the resulting ice would be cloudy, and although it would be suitable from a sanitary standpoint for chilling water and beverages, it would not have an aesthetically pleasing appearance. Therefore, to produce clear ice, air is pumped into and percolated through the water as it is being frozen. Conventionally, ambient outside air is used, and since the ice must be sanitary and potable, the air must be filtered. Also, ambient air is usually at a temperature well above the freezing point of water, and gives up its heat to the water, which increases the load on the icemaker.

OBJECTS OF THE INVENTION

An object of the present invention is to provide an improved air sparge system for an icemaker and ice dispenser combination, in which air percolated through water being frozen to ice in the icemaker is obtained from an ice storage hopper of the ice dispenser and recirculated between the icemaker and ice dispenser.

Another object is to provide an improved air diffuser for an icemaker, which uniformly percolates air into water in the icemaker.

SUMMARY OF THE INVENTION

In accordance with the present invention, an ice making and dispensing apparatus comprises an ice dispenser having a hopper for reception of a mass of particles of ice; an icemaker having an ice evaporator water space for containing and freezing water to ice; and air sparge means, coupled with said ice dispenser and said icemaker, for introducing air from within said hopper into said ice evaporator water space for percolation through water in said space while the water is being frozen to ice.

The invention also contemplates a method of operating an ice making and ice dispenser system, which comprises the steps of providing ice in a hopper of an ice dispenser; supplying refrigerant to an evaporator contained in a well of an icemaker; introducing water into the well and into contact with the evaporator, the refrigerant being at a temperature such that the evaporator is chilled to freeze the water to ice; and percolating air from within the hopper through the water in the well while the evaporator is freezing the water to ice.

Other objects, advantages and features of the invention will become apparent upon a consideration of the following detailed description, when taken in conjunction with the accompanying drawings.

DETAILED DESCRIPTION

Figure 1:
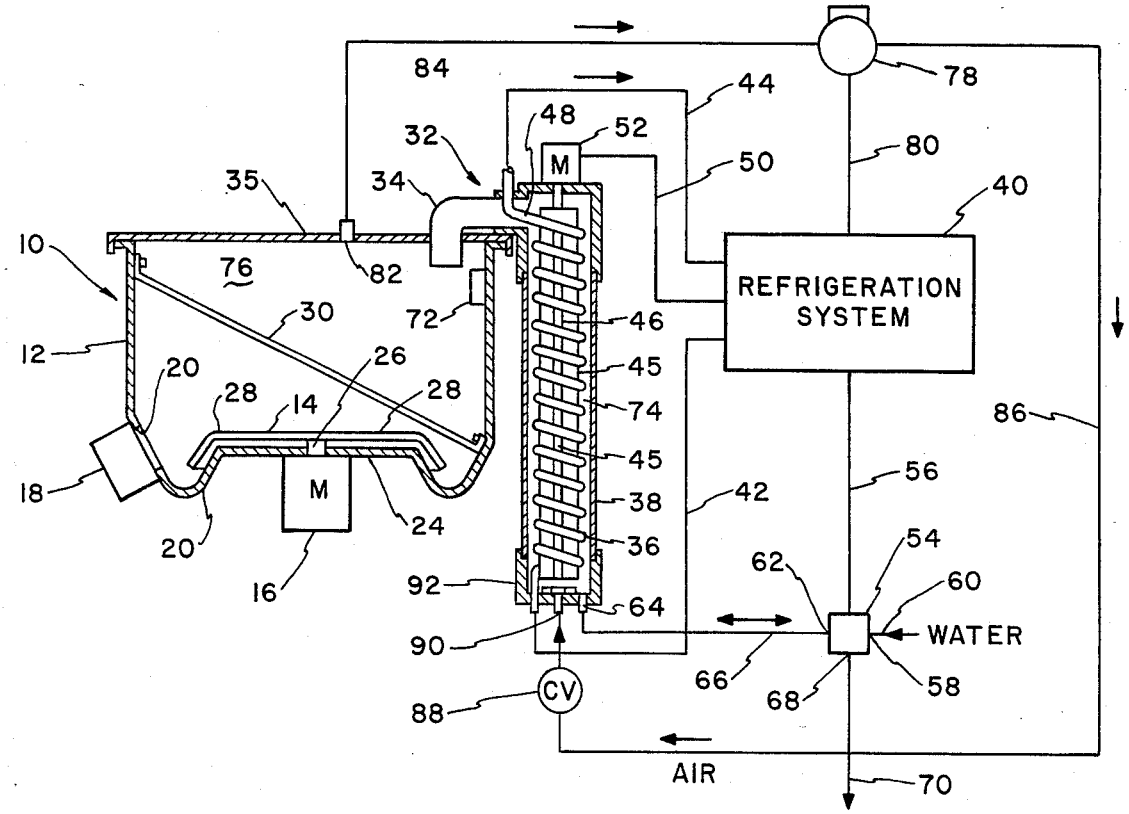
FIG. 1 is a side elevation view, partly in cross section and partly schematic, illustrating an icemaker and ice dispenser combination having an improved air sparge system in accordance with the teachings of the present invention.

The icemaker and ice dispenser combination illustrated in FIG. 1 comprises an ice dispenser, indicated generally at 10, that includes a hopper 12 for storing a mass of discrete particles of ice, a rotary agitator 14 driven by an electric motor 16, and dispensing means 18 for accommodating controlled discharge of ice from a lower end of the hopper through a discharge opening 20. The dispensing means, although not forming part of the invention, is desirable to enable convenient dispensing of ice from the hopper, and may take the form of any of the dispensing means disclosed in U.S. Pat. Nos. 3,165,901, 3,211,338 and 3,217,509, the teachings of which are specifically incorporated herein by reference.

The hopper 12 is essentially an open top tube, and preferably is of polygonal cross section as disclosed in U.S. Pat. No. 3,517,860, to facilitate maintaining the particles of ice in discrete, free flowing form. The bottom of the hopper has a circular depression comprising an annular trough 22 in which the discharge opening 20 is formed. The opening is spaced a short distance above the bottom of the trough, and the trough is appropriately provided at its bottom with melt water drain holes (not shown), so that only discrete particles of relatively dry ice will be discharged through the opening. The bottom of the hopper is closed by an end wall 24, whereby ice to be discharged gravitates into and is confined within the trough.

The hopper bottom wall 24 is centrally apertured for upward, liquid sealed passage of a shaft 26 of the motor 16, the motor being suitably mounted on the wall exteriorly of the hopper. Fastened to the motor shaft within the hopper interior is the impeller 14, which has a plurality of radial arms 28 that generally follow the contour of the hopper bottom wall and extend into the trough 20 and engage the mass of ice in the hopper to cause the same to rotate, and a rod 30 may extend from side to side and top to bottom in the hopper to provide a fixed resistance against which the rotating mass of ice may be moved to facilitate its agitation and separation into discrete, free flowing particles. The motor may comprise an electric gear motor coupled with the discharge means 18, such that the motor is operated for a short interval of time during operation of the discharge means to provide a free flow of ice therethrough.

To maintain a supply of ice in the hopper 12 and replenish ice discharged through the means 18, an icemaker, indicated generally at 32, has an ice discharge spout 34 extending through a cover 35 on the hopper into communication with the interior of the hopper. Preferably, as illustrated and as will be described, the icemaker is of the type disclosed in U.S. Pat. No. 4,429,543 to Fischer, the teachings of which are specifically incorporated herein by reference.

In essence, the icemaker 32 has a helical tubing section 36 that serves as an evaporator, with water being supplied to the outer surface thereof. The tubing section is disposed in a surrounding well 38 of circular cross section, which may be filled with water to a desired depth to immerse substantially the entire tubing section. A low-boiling point liquid refrigerant, such as Freon-22, is supplied by a refrigeration system 40 through a line 42 and an expansion valve (not shown) to a lower inlet to the tubing section. The evaporating refrigerant takes up heat from the surrounding water, causing a helix of ice to form on the exterior surface of the tubing, and is then returned from an upper outlet from the tubing section to the refrigeration system through a line 44.

When the ice helix reaches a desired wall thickness, by which time it will have grown into engagement with radially extending fins 45 of an axially located rotatable driver 46, the supply of refrigerant is halted and the tubing section 36 is heated to break the thermal bond between the interior surface of the ice helix and the exterior surface of the tubing. The driver is then rotated to harvest the ice, causing the helix of ice to unwind by traveling upward in sliding contact with the tubing section. The leading edge of the ice helix is caused to fracture into ice pieces within the discharge spout 34, and although any suitable fracturing device can be used, preferably the tubing section 36 continues as a short length 48 that is disposed either as a straight or an upwardly or sidewardly curved section, which causes the rigid ice helix to fracture as its leading end is forced to try to follow a different curvature. The fins of the driver 46 are heated to a temperature above the freezing point of water during the freezing portion of the cycle, preferably by circulating the liquid refrigerant from a condenser (not shown) of the refrigeration system to an interior section of the driver, so that the fins remain in sliding contact with the ice helix during harvest.

The refrigeration system 40 advantageously includes the components of the refrigeration system disclosed by said U.S. Pat. No. 4,429,543. In addition, it includes controls (not shown) of a conventional type, for applying power through a conductor 50 to a motor 52 coupled with the driver 46 for rotating the driver during an ice harvest cycle, and for operating a valve 54 via a control line 56. An inlet 58 to the valve connects with a supply of water through a line 60, a combination inlet/-outlet 62 of the valve connects with a water inlet/outlet 64 of the well 38 through a line 66, and an outlet 68 from the valve is coupled to a drain through a line 70. The valve is operable by the refrigeration system to selectively establish a path between the inlet 58 and the inlet/outlet 62, to establish a path between the inlet/outlet 62 and the outlet 68, or to interrupt all paths through the valve. At the beginning of an ice harvest cycle, a path is established between the inlet/outlet 62 and the outlet 68 to drain remaining unfrozen water from the tube 38 through the drain line 70. After the water is drained, the helix of ice on the evaporator 36 is harvested and, prior to the end of the harvest cycle, the valve is operated to establish a path between its inlet 58 and its inlet/outlet 62, so that fresh water is introduced into the tube to immerse the tubing section to a predetermined level in preparation for the next ice freezing cycle. Draining unfrozen water from the tube at the beginning of each ice harvest cycle ensures that only fresh water is used for making ice and prevents a buildup of minerals in the tube and excess minerals in the ice.

To control operation of the icemaker 32 in order to maintain ice in the hopper 12 at a selected level, a thermostat 72, on an inside wall of the hopper in proximity with the outlet from the ice discharge chute 34, is at a level at which ice is to be maintained, and senses the presence of absence of ice therearound. Since as ice fills the hopper it tends to build up higher near its point of entry, by positioning the thermostat beneath the chute, overfilling of the hopper is prevented. The thermostat is connected to controls in the refrigeration system 40, as is the agitator motor 16, and upon ice occurring around the thermostat, the motor is briefly energized to rotate the agitator 14 and level the ice within the hopper. If the hopper is less than completely full, upon leveling the ice drops away from the thermostat, and the icemaker continues to operate. If after agitation the ice remains at the level of the thermostat, then the icemaker is turned off until sufficient ice is removed from the hopper to drop its level to beneath the thermostat.

If water within an ice evaporator water space 74 defined within the well 38 of the icemaker 32 were allowed to remain in a quiescent state during freezing, the resulting ice helix formed on the evaporator tube 36, and the particles of ice introduced into the hopper 12, would be cloudy. Although cloudy ice is suitable from a sanitary standpoint for cooling water and beverages, it is not desirable for service to customers, since it does not have an aesthetically "clean" appearance. Therefore, in order that the icemaker will procude clear ice, the art contemplates that the water in the icemaker be agitated while it is being frozen, and agitation conventionally is accomplished by pumping outside or ambient air into the bottom of the icemaker for percolation upwardly through the water to agitate the water while it is being frozen. A disadvantage of the technique is that ambient air is usually at an elevated temperature with respect to the water, so there is a transfer of heat from the air to the water that increases the load on the icemaker. Also, to ensure that the resulting ice is sanitary and potable for human consumption, the ambient air must be properly filtered before introduction into the icemaker.

In improving upon prior air percolation systems for icemakers, the invention provides an improved air sparge system for the icemaker 32 and ice dispenser 10 combination, in which air percolated through water in the ice evaporator water space 74, within the well 38, is obtained from a space 76 above ice in the hopper 12 and, after percolation through the water, is returned to the hopper through the ice discharge chute 34. Because air in the space is chilled by ice in the hopper, as it percolates through the water little, if any, heat is transferred from the air to the water, so that the capacity of the icemaker is not reduced. Also, since the air contacts only "food touching" surfaces that are maintained clean and sanitary, it is and remains free of outside contaminants, and may be used over and over again to produce clear ice.

More particularly, the air sparge system includes a motor driven air pump 78 that is operated by the refrigeration system 40, via a control line 80, during each ice freezing cycle of the icemaker 32. An inlet to the pump connects to an outlet 82 in the hopper cover 35 through an air line 84, and an outlet from the pump connects through an air line 86 and a check valve 88 to an air inlet 90 of a cap 92 that closes the lower end of the tubular well 38. Air introduced at the inlet to the cap percolates upwardly through water in the ice evaporator water space 74, and upon reaching the top of the column of water flows out of the icemaker through the chute 34 and back into the hopper 12 for being recirculated from the hopper, to and through the icemaker, and back to the hopper.

Figure 2:
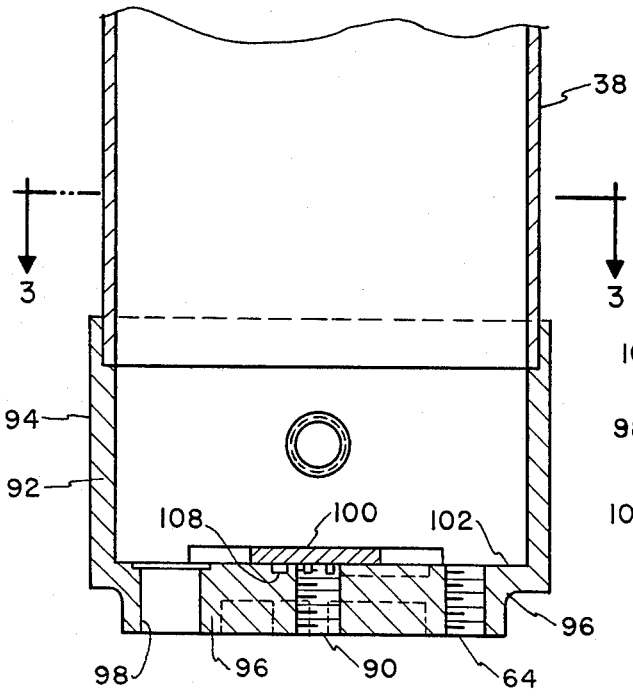
FIG. 2 is a cross sectional side elevation view of the bottom of the icemaker of FIG. 1, illustrating structural details of an air diffuser of the air sparge system.
Figure 3:
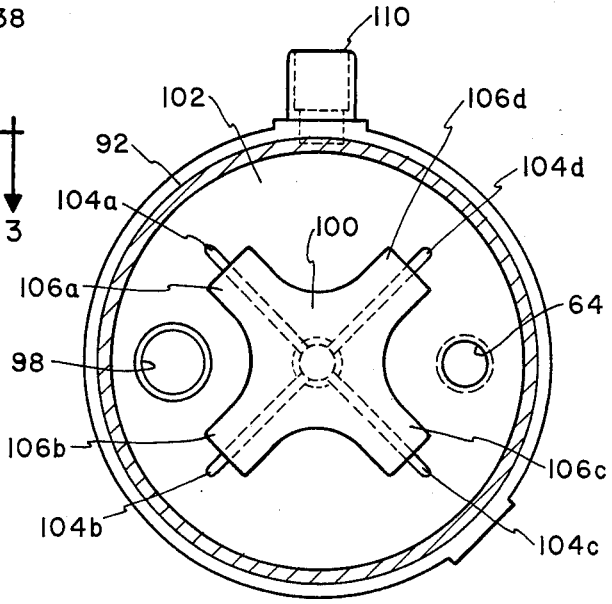
FIG. 3 is a top plan view, partly in cross section, taken substantially along the lines 3—3 of FIG. 2, and shows additional details of the air diffuser.

With reference also to FIGS. 2 and 3, the cap 92 has a cylindrical side wall 94, joined at its upper end with the lower end of the tubular well 38, and a circular bottom wall 96 which, in addition to having an axial passage defining the air inlet 90, also has a passage defining the water inlet/outlet 64 and a passage 98 through which the lower end of the tubular evaporator 36 extends in sealed relationship.

The cap 92, along with an air diverter 100, together comprise an air diffuser that introduces air into the bottom of the column of water in the well 38, such that the air percolates upwardly through the water in a manner to uniformly agitate the water, at least in proximity to the helical evaporator 36, to ensure that only clear ice is frozen onto the evaporator. To accomplish diffusion of air into the column of water, formed in an upper surface 102 of the cap bottom wall 96, and extending radially at 90° intervals from and in communication with the upper end of the air inlet 90, are four channels or slots 104*a–d*.

The air diverter 100 is supported on the upper surface 102 of the cap bottom wall 96, and comprises a generally flat plate of cruciform shape that has four arms 106*a–d* that are adapted to overlie respective ones of the radial channels 104*a–d* for the greater portion of their length, leaving exposed only the radially outer ends of the channels. To properly orient the air diverter on the surface, with the arms 106*a–d* in overlying relation to the radial channels 104*a–d*, the lower surface of the air diverter is provided with a locating pin 108 that is received in a recess in the surface 102. With the air diverter in place, air introduced at the inlet 90 flows radially outwardly through the channels 104*a–d*, exiting the channels at their outer ends. The channels have a radial extent generally equal to the radius of the helical evaporator 36, whereby air exiting the channels percolates upwardly through the water in contact first with the evaporator tubing, and then with the ice helix as it is formed on the tubing, causing uniform agitation of at least the portion of the water proximate the tubing, so that clear ice is frozen on the tubing. Advantageously, the cap 92 also includes a probe holder housing 110, through which a probe extends for sensing when growth of the ice helix on the evaporator is sufficient for harvesting the ice, for example by contact of ice with the probe.

While embodiments of the invention have been described in detail, various modifications and other embodiments thereof may be devised by one skilled in the art without departing from the spirit and scope of the invention, as defined in the appended claims.

What is claimed is:

1. Ice making and dispensing apparatus, comprising an ice dispenser having a hopper for reception of a mass of particles of potable ice; an icemaker having an ice evaporator water space for containing and freezing water to ice; air sparge means, coupled with said ice dispenser and said icemaker, for introducing air from within said hopper into said ice evaporator water space for percolation through water in said space while the water is being frozen to ice; and means connecting said ice evaporator water space with the interior of said hopper for returning air that has percolated through the water in said space to said hopper, said hopper, ice evaporator water space, air sparge means and connecting means being substantially closed to ambient air, whereby air is recirculated in a substantially closed loop from said hopper, through said ice evaporator water space and back to said hopper, and is maintained in a sanitary and potable condition and substantially free from contaminants in the ambient air.

2. Apparatus as in claim 1, wherein said air sparge means includes an air pump, having an inlet coupled with the interior of said hopper and an outlet coupled with said ice evaporator water space, for moving air from within said hopper to said space for percolation through water in said space and return to said hopper.

3. Apparatus as in claim 1, wherein said ice evaporator water space comprises a well for containing water and an evaporator in said well for freezing water to ice, said icemaker includes an ice discharge chute extending between said well and said hopper and means for moving water frozen into ice in said well through said chute and into said hopper, and said air sparge means introduces air from said hopper into said well for percolation through water in said well while said evaporator is freezing the water to ice, said chute comprising said connecting means and providing a return path for air, that has percolated through the water, back to said hopper.

4. Apparatus as in claim 3, wherein said chute is toward and upper end of said well, said air sparge means introduces air into a lower end of said well, and said evaporator freezes water to ice in said well intermediate said lower and upper ends thereof.

5. Apparatus as in claim 4, wherein said lower end of said well is generally circular, and said air sparge means introduces air into said well at a plurality of locations radially outwardly of the axial center of said lower end.

6. Ice making and dispensing apparatus, comprising an ice dispenser having a hopper for reception of a mass of particles of ice; an icemaker having an ice evaporator water space for containing and freezing water to ice; and air sparge means, coupled with said ice dispenser and said icemaker, for introducing air from within said hopper into said ice evaporator water space for percolation through water in said space while the water is being frozen to ice, wherein said ice evaporator water space comprises a well for containing water and an evaporator in said well for freezing water to ice, and said air sparge means includes a generally circular wall closing a lower end of said well, said well having an axial passage therethrough and a plurality of channels in a surface within said well, said channels extending radially from and in communication with said passage, and an air diverter plate on said wall surface, said air diverter plate extending across said passage and said channels toward but spaced from radially outer ends of said channels, and means for moving air from said hopper into said passage for flow through said channels to said radially outer ends thereof for introduction into said well and percolation through water therein.

7. Apparatus as in claim 6, wherein said well is generally circular in cross-section and said evaporator is helical in shape.

8. Apparatus as in claim 7, wherein said plurality of channels comprise four channels at about 90° apart, and said radially outer ends of said channels generally underlie said evaporator.

9. A method of operating an ice making and ice dispensing system, comprising the steps of providing potable ice in a hopper of an ice dispenser; supplying refrigerant to an evaporator contained in a well of an icemaker; introducing water into the well and into contact with the evaporator, the refrigerant being at a temperature such that the evaporator is chilled to freeze the water to ice; percolating air from within the hopper through the water in the well while the evaporator is freezing the water to ice; returning air that has percolated through the water in the well to the interior of the hopper, whereby air is recirculated in a loop from the hopper, through the well and back to the hopper; and maintaining the air recirculated in the loop out of substantial contact with ambient air, so that the air is maintained in a sanitary and potable condition and substantially free from contaminants in the ambient air.

10. A method as in claim 9, wherein said percolating step includes the step of pumping air from within the hopper into the water toward a lower end of the well.

11. A method as in claim 9, including the steps of moving ice frozen in the icemaker well through a chute and into the hopper, and returning air percolated through the water through the chute to the interior of the hopper.

12. A method as in claim 11, wherein the chute is coupled with an upper end of the well, and said percolating step comprises flowing air from within the hopper into the water toward a lower end of the well.

13. A method as in claim 12, wherein the lower end of the well is generally circular, and said percolating step comprises flowing air from within the hopper into the well at a plurality of locations radially outwardly of the center of the lower end of the well.

14. A method as in claim 9, wherein the well is generally circular in cross-section, the evaporator is generally helical, and said percolating step comprises flowing air from within the hopper into the water, toward a lower end of the well, at a plurality of locations that generally underlie the evaporator.

15. A method as in claim 14, wherein said flowing step flows air into the water, toward the lower end of the well, at four positions located about 90° apart.

* * * * *